United States Patent [19]

Baker

[11] 4,050,104

[45] Sept. 27, 1977

[54] TWO-IN-ONE PERIMETER GUTTER FOR SWIMMING POOLS

[76] Inventor: William H. Baker, 911 Rawlinson Road, Rock Hill, S.C. 29730

[21] Appl. No.: 589,725

[22] Filed: June 23, 1975

Related U.S. Application Data

[63] Continuation-in-part of Ser. No. 579,997, May 22, 1975.

[51] Int. Cl.[2] ..... E04H 3/20

[52] U.S. Cl. ..... 4/172.17; 4/172.18

[58] Field of Search ..... 4/172.17, 172.18, 172.15, 4/172

[56] References Cited

U.S. PATENT DOCUMENTS

| | | | |
|---|---|---|---|
| 3,668,713 | 6/1972 | Baker | 4/172.17 |
| 3,668,714 | 6/1972 | Baker | 4/172.17 |
| 3,813,705 | 4/1974 | Spaulding | 4/172.18 |
| 3,815,160 | 6/1972 | Baker | 4/172.17 |

*Primary Examiner*—Robert I. Smith

[57] ABSTRACT

A perimeter gutter for swimming pools is provided comprising, in combination, first and second gutter conduits for disposition about the perimeter of a swimming pool, of which conduits at least one is adapted to carry water at a level below a predetermined level of water in the swimming pool; a retaining wall on the pool-side of the gutter conduits, over the top of which wall water may flow from the pool into one of the gutter conduits; the first and second gutter conduits having at least one common wall therebetween, separating interior space of the second gutter conduit from interior space of the first gutter conduit, of which common wall at least a portion is removable, so that upon removal of the wall, said interior spaces are combined and form a gutter whose interior space is greater than the interior space of either gutter conduit.

The second gutter conduit can be in fluid flow communication either with the swimming pool or with the first gutter conduit, or with both.

22 Claims, 10 Drawing Figures

TWO-IN-ONE PERIMETER GUTTER FOR SWIMMING POOLS

This application is a continuation-in-part of Ser. No. 579,997 filed May 22, 1975.

The gutter system of a swimming pool is one of its most important components, and its design is determinative of many of the characteristics of the pool. However, what constitutes good gutter design has long been a perplexing problem in much dispute. What is recognized is that a swimming pool gutter system must provide an adequate surge flow capacity, especially when the pool is filled with swimmers, and it should not flood when a large group of swimmers enters the pool all at once. It should also provide a good surge-and wave-quelling capacity. Its ability to cope with surges and waves produced by swimmers is quite important to the competitive qualities of the swimming pool.

A problem related to gutter design is the removal of surface dirt. Some types of gutters are designed to provide a skimming action, but it has generally been conceded that the most efficient type of skimming action is provided by the scum gutter type of pool, and on all pools over 1,600 square feet in area, scum gutters are provided as a matter of course. In fact, in some states, surface skimmers are not permitted.

One type of swimming pool with a perimeter gutter provides for flow of water over the top of the gutter wall into the gutter trough at all times. Such a gutter system is described in U.S. Pat. No. 2,932,397 to Ogden dated Apr. 12, 1960. Another and older design appears in U.S. Pat. No. 1,797,397 to Booraem dated Mar. 24, 1931. Such a gutter provides a most efficient skimming action under normal flow conditions, but as soon as swimmers enter the pool, or a heavy surge or wave action is encountered, the additional flow of water over the top of the gutter tends to flood the gutter, after which skimming action is lost, until the water can be drained away, and in fact some of the dirt already in the gutter may be washed back.

In an attempt to alleviate such a condition, a modification of the Ogden gutter has been proposed in U.S. Pat. No. 3,363,767 to Ellis dated Jan. 16, 1968, incorporating a plurality of skimmer openings spaced around the gutter at a lower level than the top of the gutter. In this system, when the pool is not in use, the skimmer weir is opened and skimming is obtained via the openings into the gutter (column 2, lines 19 to 24). When the pool is in use, the skimmer weirs are closed (column 2, lines 12 to 13), but the water level is held down below the lip of the gutter, providing a certain in-pool surge capacity, and avoiding a flooded gutter condition at the time of flow surges. However, when the pool is in heavy use and there is considerable wave or surge action over the top of the gutter, surface contaminants washed into the gutter may still be washed back into the pool.

U.S. Pat. Nos. 3,668,712 and 3,668,714, patented June 13, 1972 to Baker, provide perimeter skimming gutters for swimming pools which can permit an adequate skimming action at all times, and provide an adequate surge capacity when the pool is in use, without the possibility of the gutter's flooding or dirt in the gutter's being washed back into the pool.

This is accomplished in U.S. Pat. No. 3,668,712 by combining a plurality of narrow, elongated, substantially horizontally disposed openings which are open at all times in a retaining wall disposed about the perimeter of the swimming pool, with the peripheral gutter conduit arranged to receive water spilling over the top of the retaining wall when the flow capacity of the elongated openings is exceeded. The elongated openings can be arranged to feed water into the main gutter conduit, or into a separate second gutter conduit, so as to keep these two water flows completely separate, and retain the dirt skimmed off the top of the pool in a separate place, to avoid the hazard of this dirt's being washed back into the pool, in the unlikely event of the first gutter conduit's being flooded during wave actions or surges. In this gutter system, the water level in the pool is normally maintained at the level of the skimmer openings in the gutter.

In U.S. Pat. No. 3,668,714, the perimeter skimming gutter comprises a first gutter conduit for dispostion about the perimeter of a swimming pool, and adapted to carry water at a level below a predetermined level of water in the swimming pool; a retaining wall on the pool-side of the first gutter conduit, over the top of which wall water may flow from the pool into the first gutter conduit; and a second gutter conduit in fluid flow connection with the first, such fluid flow connection entering the first gutter conduit at a level below the top of the retaining wall, and adapted to drain off water from the first gutter conduit at any level exceeding a predetermined maximum level therein, so as to inhibit the level of water in the first gutter conduit from reaching the top of the retaining wall.

U.S. Pat. No. 3,668,713, patented June 13, 1972 to Baker, provides a fluid flow and/or fluid pressure responsive gate weir for swimming pools, comprising in combination, a weir support; a fluid flow passage in the support; a gate member pivotably mounted in the support across the passage between flow-open and flow-closed positions; a gate control means disposed to encounter a fluid flow through and/or fluid pressure in the passage above a predetermined minimum, and responsive to such flow and/or pressure to pivot the gate member from a flow-open towards a flow-closed position; and means arranged to retain the gate member in the flow-open position under normal conditions fluid flow and/or fluid pressure through the weir passage and to permit pivotal movement of the gate members towards a flow-closed position while such excessive fluid flow and/or fluid pressure continues.

Means can also be provided to return the gate member to the flow-open position when such excessive flow and/or pressure subsides, and/or returns to normal.

U.S. Pat. No. 3,815,160, patented June 11, 1974, to Baker, provides a nonflooding perimeter skimming gutter wall for swimming pools, including a first gutter conduit for disposition aboutthe perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit within a peripheral wall below the first gutter conduit and adapted to carry water at a level above a predetermined level of water in the first gutter conduit, and a fluid flow connection between the two gutter conduits at such level and below the top of the retaining wall allowing water to flow from the first gutter conduit into the second gutter conduit whenever the water level on the first gutter conduit reaches the fluid flow connection, thereby inhibiting filling of the first gutter conduit appreciably above such level.

In the twin gutter structures provided in these patents, the two gutters are separate, and of fixed dimensions. While the gutters can be interconnected at a number of locations, flow therebetween is normally not possible until one or the other reaches a predetermined overflow level. This is highly desirable in most circumstances, but on occasion a single gutter of large capacity may be preferred. In a fixed-in-place structure of the type described, this is not possible to achieve.

In accordance with the instant invention, a twin gutter system is provided in which the twin gutters can be kept separate or combined in one, as desired, by forming the two gutters with at least one common wall, of which at least a portion thereof can be removed. This feature can be applied in any of the twin gutter systems of U.S. Pat. Nos. 3,688,712, 3,668,713, 3,668,714, and 3,815,160, with or without a skimming function, as desired. The common wall can be all or part of a side wall, an end wall, a bottom wall, or a corner wall, of the gutters, as is illustrated in the drawings, which show preferred structural embodiments.

In accordance with the invention, a perimeter gutter for swimming pools is provided comprising, in combination, first and second gutter conduits for disposition about the perimeter of a swimming pool, of which conduits at least one is adapted to carry water at a level below a predetermined level of water in the swimming pool; a retaining wall on the pool-side of the gutter conduits, over the top of which wall water may flow from the pool into one of the gutter conduits; the first and second gutter conduits having at least one common wall therebetween, separating interior space of the second gutter conduit from interior space of the first gutter conduit, of which common wall at least a portion is removable, so that upon removal of the wall, said interior spaces are combined and form a gutter whose interior space is greater than the interior space of either gutter conduit.

The first and second gutter conduits can be in fluid flow communication either with the swimming pool or with each other, or with both.

According to one embodiment, the perimeter skimming gutter for swimming pools provided in accordance with the invention comprises, in combination, a first gutter conduit for disposition about the perimeter of a swimming pool, and adapted to carry water at a level below a predetermined level of water in the swimming pool; a retaining wall on the pool-side of the first gutter conduit, over the top of which wall water may flow from the pool into the first gutter conduit; and a second gutter conduit in fluid flow communication either with the swimming pool or with the first gutter conduit, such fluid flow communication being at a level below the top of the retaining wall; the first gutter conduit being removable, and at least one wall thereof being a wall of the second gutter conduit separating interior space of the second gutter conduit from interior space of the first gutter conduit, so that upon removal of the first gutter conduit, said interior spaces are combined and become interior space of the second gutter conduit, forming one gutter whose interior space is greater than the interior space of the second gutter conduit.

This twin system can be provided with any desirable skimming function.

In another embodiment, the perimeter skimming gutter for swimming pools provided in accordance with the invention comprises, in combination, a first gutter conduit for disposition about the perimeter of a swimming pool and adapted to carry water at a level below a predetermined level of water in the swimming pool; a retaining wall on the pool-side of the gutter conduit, over the top of which wall water may flow from the pool into the first gutter conduit; a second gutter conduit in fluid flow communication either with the swimming pool or with the first gutter conduit, such fluid flow communication being at a level below the top of the retaining wall; and a plurality of narrow, elongated skimmer openings through the wall below the top thereof at a height to maintain a predetermined water level in the pool, and providing a skimming flow of water through the skimmer openings into one of the gutter conduits at such a predetermined water level, the top of the wall being spaced above the openings at a height to retain the pool water within the pool perimeter at water flows, wave actions and surges up to a predetermined maximum, while allowing excessive water flows, wave actions and surges beyond such maximum to flow over the top of the wall into the first gutter conduit; the first gutter conduit being removable, and at least one wall thereof being a wall of the second gutter conduit separating interior space of the second gutter conduit from interior space of the first gutter conduit, so that upon removal of the first gutter conduit, said interior spaces are combined and become interior space of the second gutter conduit, forming one gutter whose interior space is greater than the interior space of the second gutter conduit.

According to another embodiment, the perimeter skimming gutter for swimming pools provided in accordance with the invention comprises, in combination, a first gutter conduit for disposition about the perimeter of a swimming pool, and adapted to carry water at a level below a predetermined level of water in the swimming pool; a retaining wall on the pool-side of the first gutter conduit, over the top of which wall water may flow from the pool into the first gutter conduit; and a second gutter conduit in fluid flow communication with the first, such fluid flow communication entering the first gutter conduit at a level below the top of the retaining wall, and adapted to drain off water from the first gutter conduit at any level exceeding a predetermined maximum level therein, so as to inhibit and preferably prevent the level of water in the first gutter conduit from ever reaching the top of the retaining wall; the first gutter conduit being removable, and at least one wall thereof being a wall of the second gutter conduit separating interior space of the second gutter conduit from interior space of the first gutter conduit, so that upon removal of the first gutter conduit, said interior spaces are combined and become interior space of the second gutter conduit, forming one gutter whose interior space is greater than the interior space of the second gutter conduit.

In another embodiment, the perimeter skimming gutter for swimming pools in accordance with the invention comprises, in combination, a first gutter trough for disposition about the perimeter of a swimming pool, and adapted to carry water at a level below a predetermined level of water in the swimming pool; a retaining wall on the pool-side of the trough, over the top of which wall water may flow from the pool into the gutter trough; a second gutter conduit in fluid flow communication either with the swimming pool or with the first gutter conduit, such fluid flow communication being at a level below the top of the retaining wall; the first gutter conduit being removable, and at least one wall thereof being a wall of the second gutter conduit separating interior space of the second gutter conduit from interior space of the first gutter conduit, so that upon removal of the first gutter conduit, said interior spaces are combined and become interior space of the second gutter conduit, forming one gutter whose interior space is greater than the interior space of the second gutter conduit; and a weir closure member disposed through the retaining wall below the top thereof, at a height to maintain a predetermined water level in the pool, and to provide a skimming flow of water through the weir passage at such predetermined water flow from the pool, the top of the wall being spaced above the weir at a height to retain the pool water within the pool perimeter when the weir is closed at water flows, wave actions, and surges up to a predetermined minimum, while allowing excessive flows, wave actions, and surges beyond such minimum to flow over the top of the wall into the gutter trough, the weir comprising a weir support; a fluid flow passage; a weir closure member mounted in the support across the passage to move between flow-open and flow-closed positions, and a weir closure control responsive to fluid level and/or fluid flow and/or fluid pressure and which in the flow-open position is disposed to encounter a fluid level and/or fluid flow and/or fluid pressure through the passage above a predetermined minimum, and responds to the motive force applied by such fluid level and/or fluid flow and/or pressure to move the member from the flow-open position towards a flow-closed position.

Another embodiment of the invention is a nonflooding perimeter skimming gutter wall for swimming pools, including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit within a peripheral wall below the first gutter conduit and adapted to receive water at a level above the predetermined level of water in the first gutter conduit, the first and second gutter conduits having at least one common wall of which at least a portion is removable, the portion when removed exposing a fluid flow connection between the two gutter conduits at such level and below the top of the retaining wall allowing water to flow from the first gutter conduit into the second gutter conduit whenever the water level on the first gutter conduit reaches the fluid flow connection, thereby inhibiting filling of the first gutter conduit appreciably above such level.

The term "conduit" as used herein is inclusive of open conduits or troughs as well as partially or wholly enclosed conduits.

In a preferred embodiment of the invention skimmer openings are provided leading from the swimming pool into the second gutter conduit, while over the top of the retaining wall the water feeds directly into the first gutter conduit.

In a still more preferred embodiment of the invention, a water feed conduit is provided about the perimeter of the swimming pool, for feed of fresh water into the pool. This conduit is preferably an integral part of the perimeter skimming gutter, and is disposed beneath the second gutter conduit.

Preferred embodiments of the invention are illustrated in the drawings, in which.

Figure 1:
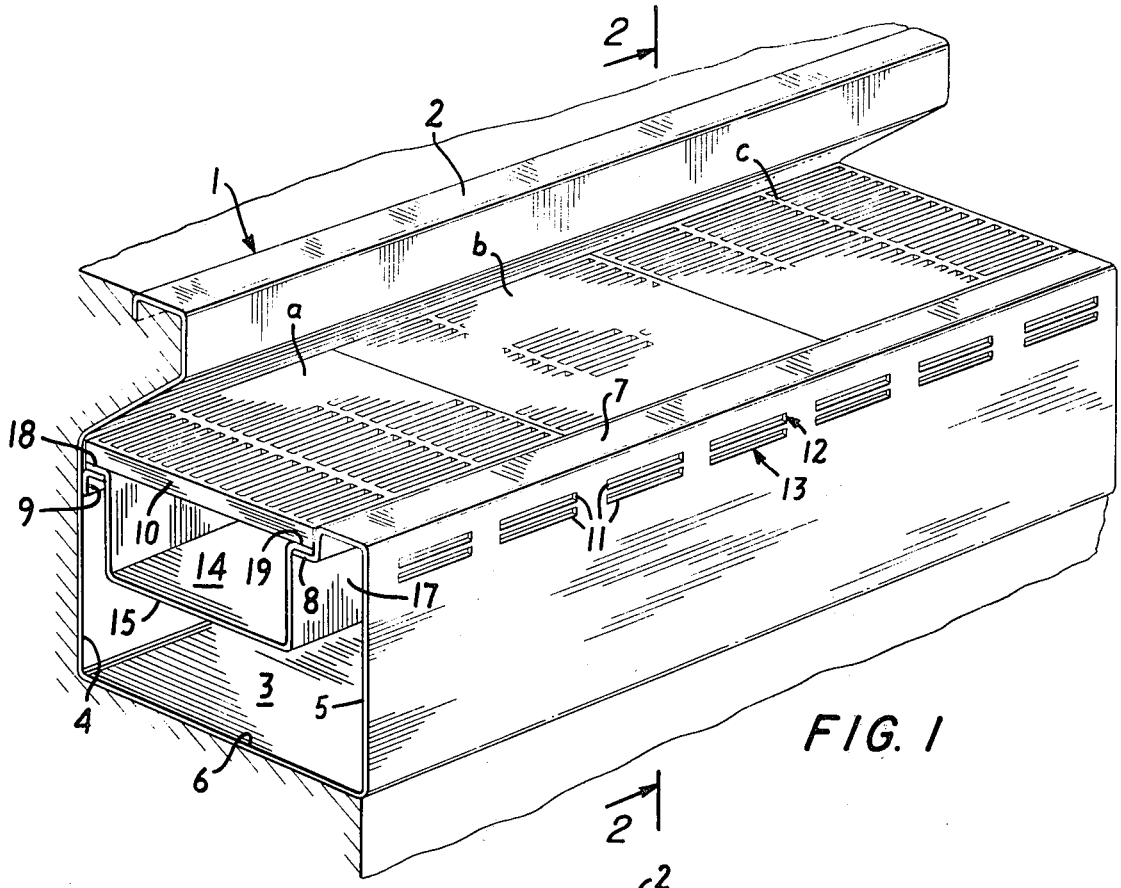
FIG. 1 represents a view in elevation of one embodiment of perimeter gutter in accordance with the invention.
Figure 2:
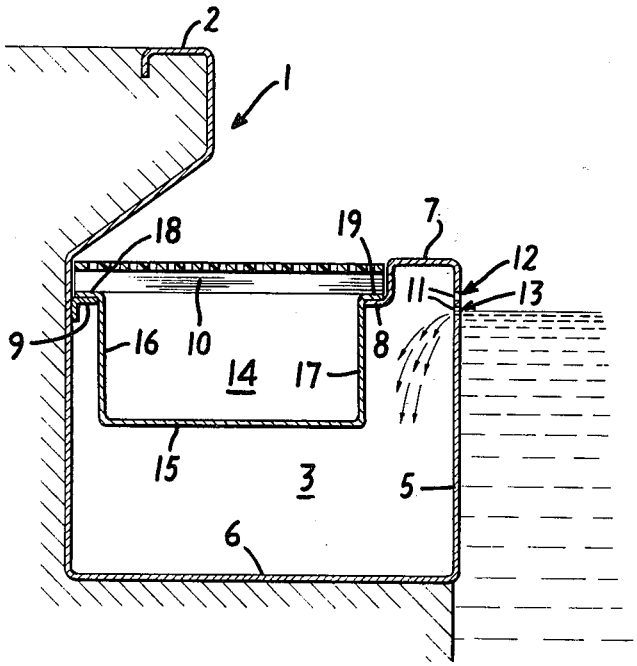
FIG. 2 represents a view in cross-section taken along the line 2—2 of FIG. 1.

The perimeter gutter of FIGS. 1 and 2 is made of a number of modular units, which are assembled on-site and bonded together by welding, soldering or brazing, to form a gutter extending around substantially the entire circumference of the swimming pool. Each unit 1 is made of stainless steel sheet, formed with a top coping 2, and a gutter trough 3 with upstanding sides 4, 5 and a bottom 6. The side 5 is designed to serve as the pool retaining wall on the pool-side of the gutter, and terminates at a flat top portion 7 and a flange 8. A mating flange 9 is attached to the side wall 4 at the same height above the gutter bottom 6. The flanges 8 and 9 support a lift-out U-shaped gutter trough 14 with a bottom 15 and sides 16, 17, terminating in flanges 18, 19, and a lift-out grate 10 made of a number of short abutting grate sections *a, b, c.* The trough 14 and grate 10 are individually removable, and merely rest on the flanges 8, 9. If the trough is removed, the grate 10 can be replaced without it, and will then rest on the flanges 8, 9. The grates are made of Cycolac plastic material (acrylonitrile-butadiene-styrene polymer) and have approximately 50% open area. These protect the troughs 14, 3 against the entry of a large debris and also prevent injury to the bathers, who might otherwise be able to step into the trough by accident.

Formed in the retaining wall 5 is a plurality of elongated narrow, substantially horizontal slots 11, which are disposed in two parallel rows 12, 13 at a level substantially above the bottom 6 of the trough, but only a short distance from the top 7 of the retaining wall 5.

The skimming slots can be arranged in size and in number so as to provide from 50 to 75 percent of the pool perimeter at the water level for constant skimming, equivalent to a gutter-type pool when the pool is not in use. In addition, there is an in-pool surge capacity sufficient to accommodate the surge caused by swimmers without flooding the gutter trough, while at the same time providing an excellent wave-quelling effect (faster calming and faster wave subsidence) because of access to the gutter trough over the top 7 of the retaining wall 5 of the gutter. In the embodiment shown, however, the open area presented by these slots constitutes 75% of the perimeter at the water level.

FIG. 2 shows the normal water level of a pool in which this perimeter gutter is installed. This level is defined by the slots 11 in the lower row 13 of the retaining wall 5. The provision of two rows of such slots provides the skimming action over a wide range of water circulating flow, since at high flows the water level may rise to the upper row 12, and water then may flow through slots in both rows, the skimming action then being provided by the upper row 12 instead of the lower row 13.

As shown in FIG. 2, water enters the gutter trough 3 via the slots 11, runs to the water recirculating system by gravity, and passes through the pool water recirculating system to the filter and the pump (not shown, but of conventional design), whence the water is returned to the pool by way of a suitable water feed system. Dirt of a size that can enter the slots is thereby carried into the gutter trough, and removed from the surface of the pool.

The spacing of the slots below the top 7 of the retaining wall 5 provides a reserve pool water surge capacity, to accommodate the surge created when swimmers enter the pool. Even though in the event of such a surge the pool may initially rise to a level above both rows of slots 12, 13, it will be apparent that if the inlet flow is less than the capacity of the slot system, the water level will gradually be reduced to the level shown in FIG. 2. When, however, the pool is rather full, or when it is in competition use, with a considerable amount of wave action, more than can be contained by wall 5, the waves and surges can lap over the top 7 of the retaining wall 5 into the gutter 14. Thus, the skimming flow is kept separate from the gutter trough 14, and debris skimmed off by this flow cannot return to the pool if gutter trough 14 floods.

The skimming slots can be arranged in size and in number so as to provide from 50 to 75% of the pool perimeter at the water level for constant skimming, equivalent to a gutter-type pool when the pool is not in use. In addition, there is an in-pool surge capacity sufficient to accommodate the surge caused by swimmers without flooding the gutter trough, while at the same time providing an excellent wave-quelling effect (faster calming and faster wave subsidence) because of access to the gutter trough 14 over the top 7 of the retaining wall 5 of the gutter.

Figure 3:
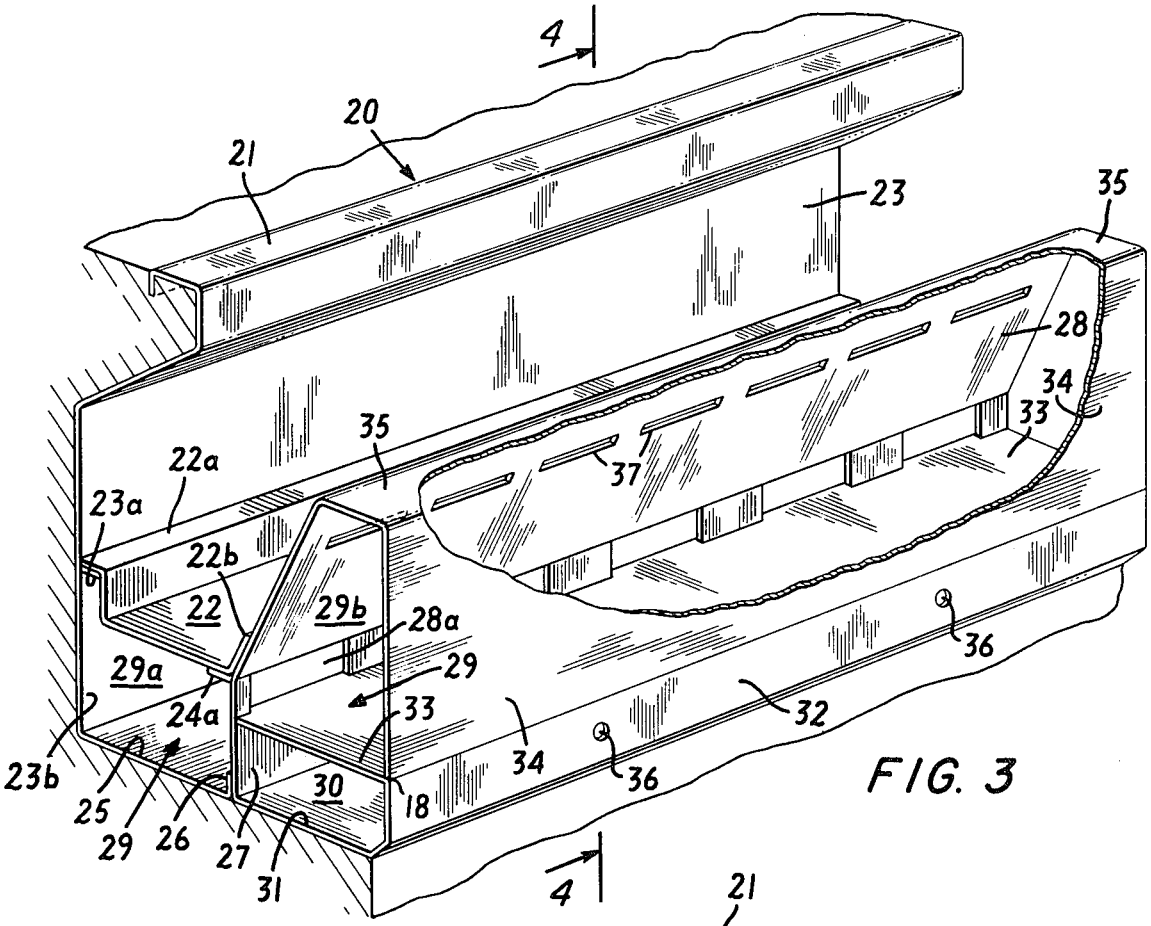
FIG. 3 represents a view in elevation of a second embodiment of perimeter gutter in accordance with the invention incorporating a water feed conduit.
Figure 4:
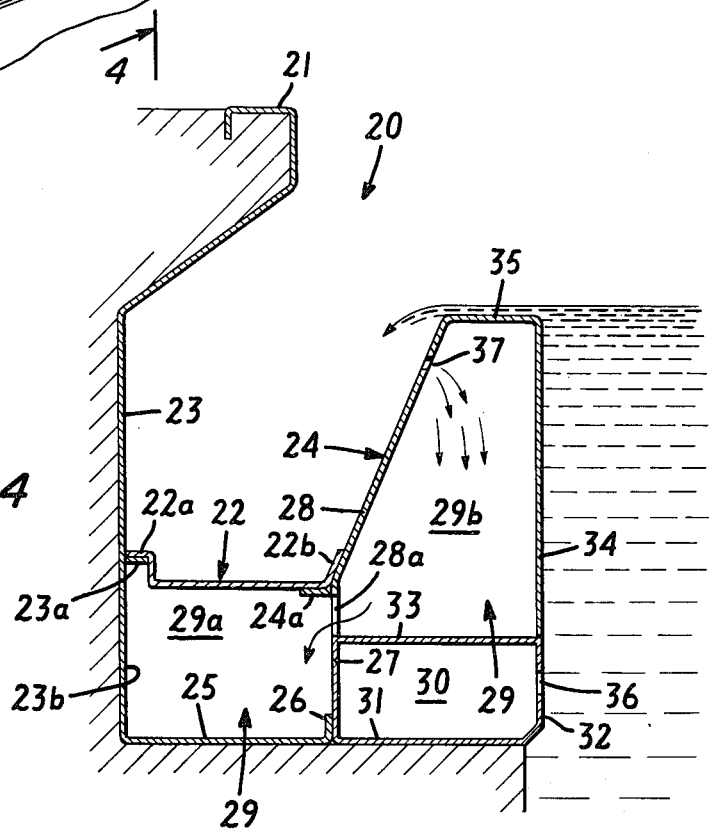
FIG. 4 represents a view in cross-section taken along the line 4—4 of FIG. 3.

The gutter system in FIGS. 3 and 4 is similar to that of FIGS. 1 and 2, with the provision of a clean water feed conduit 30 below the upper portion **29*b* of gutter conduit 29. The perimeter gutter is also made up of a number of modular gutter units 20, which are fitted together about the perimeter of the pool during construction of the pool, the abutting ends being bonded together by welding, brazing or soldering. The open gutter trough 22 is removable, and made of a sheet of stainless steel, formed in the U-configuration shown in FIGS. 3 and 4. The trough 22 has flanges 22*a*, 22*b* resting on flanges 23*a*, 24*a* of walls 23, 24**.

The perimeter gutter units 20 each have a top coping 21 and are formed with upstanding sides 23, 24 and the bottom 25 which when the gutter trough 22 is in place also actually define the lower portion **29*a* of the second gutter conduit 29. The wall 24 as shown is in two portions: portion 28, which actually separates the trough 22 and second gutter conduit 29, and portion 27, which is a side wall of the water inlet feed conduit 30. The portion 28 has a number of openings 28*a* therethrough, so that water can flow from the upper portion 29*b* into the lower portion 29*a* of the gutter conduit 29**.

The inlet feed conduit 30 is formed of stainless steel tubing, and the upper portion **29*b* of the closed gutter conduit 29 is formed of a sheet of stainless steel, folded around in a ⊓, and butt-welded at its ends to the top of the sides 27, 32 of the feed conduit 30. The feed conduit 30 has a bottom 31 and a pool-side 32, with a top 33 serving also as the bottom of the upper portion 29*b* of the second gutter conduit 29 directly above. The second gutter conduit 29 has a coping side 23*b*, bottom 25, a side wall 24 with portions 26, 27, 28, a top 35, an upstanding pool-side 34 and a bottom 33. The sides 32, 34 together constitute a retaining wall about the perimeter of the pool, as it is best seen in FIG. 4**.

The water feed conduit 30 includes in pool-side wall 32 a plurality of openings 36, regularly spaced about the pool, and serving as pool feed inlets for clean water from the feed conduit 30 into the pool, below the surface of the water level in the pool, as seen in FIG. 4. The side 28 of the gutter conduit 29 is provided a short distance below the top with a plurality of horizontal slots 37. These provide at the water level shown an open area for flow equal to about 75% of the perimeter of the gutter trough 22, but the open area can be as low as desired, down to 1% or less, since they need provide only a gutter overflow capacity.

The skimming action of this gutter system is similar to that of FIGS. 1 and 2. The water level in the pool is at the top 35 of the gutter, and the water flow across the top 35 of the gutter provides the skimming action, dirt being washed over the top into the gutter trough 22. Water in the trough is fed back through the water-recirculation system to the filter pump, where it is cleaned, and then recirculated to the pool by way of the feed conduit 30 and inlets 36. The water inlet feed by way of the conduit 30 and the openings 36 through the wall 32 provides a uniform distribution of fresh water throughout the perimeter of the pool, matching the skimming flow, which is equally uniform about the perimeter of the pool by way of the top of the gutter 35.

In the event that the water level in the pool rises, due to swimmers entering the water, and also in the case of water surges or wave action, the flow of water across the top 35 of the gutter is increased, and the amount of water in the gutter trough 22 rises. If the water level in the trough 22 reaches the slots 37 in the wall 28, flow then begins through the slots into the second gutter conduit 29, and such flow prevents the water level in the trough 22 from rising further. The flow capacity of the slots is such that it is most unlikely, if not impossible, that the water level in the gutter trough 22 will ever rise appreciably above this level, thus preventing flooding of the gutter, and also preventing any dirt in the gutter trough 22 from being washed back into the pool. Even if the flow capacity of the slots 37 is exceeded momentarily, there is still a reserve wall height between the slots 37 and the top 35 of the gutter which will prevent flooding. While the water level is at the slots 37, the slots continue the skimming action of the top 35 of the gutter, and the dirt washed over the top 35 into the gutter trough 22 then proceeds through slots 37 into the gutter conduit 29, whence it is carried off by the pool recirculation system to the filter, and removed, before the water is recirculated to the pool.

If desired, the combined capacity of gutters 22, 29 can be made into one gutter, merely by lifting out gutter trough 22. Now, all water crossing the top 35 of the gutter enters the lower section of gutter 29, which can fill into the upper section as well as through section 22 before reaching the top 35.

Figure 5:
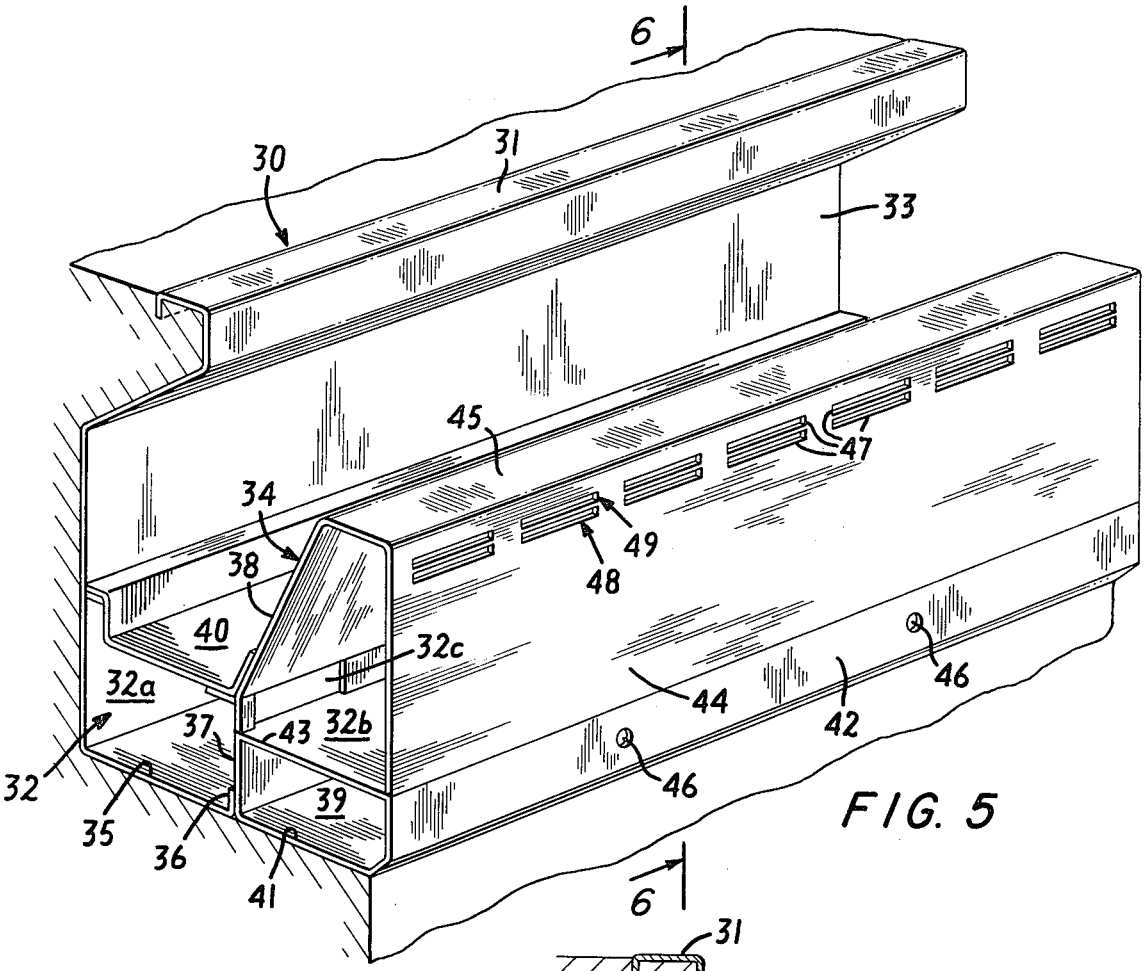
FIG. 5 represents a view in elevation of a third embodiment of perimeter gutter in accordance with the invention, incorporating a water-feed conduit.
Figure 6:
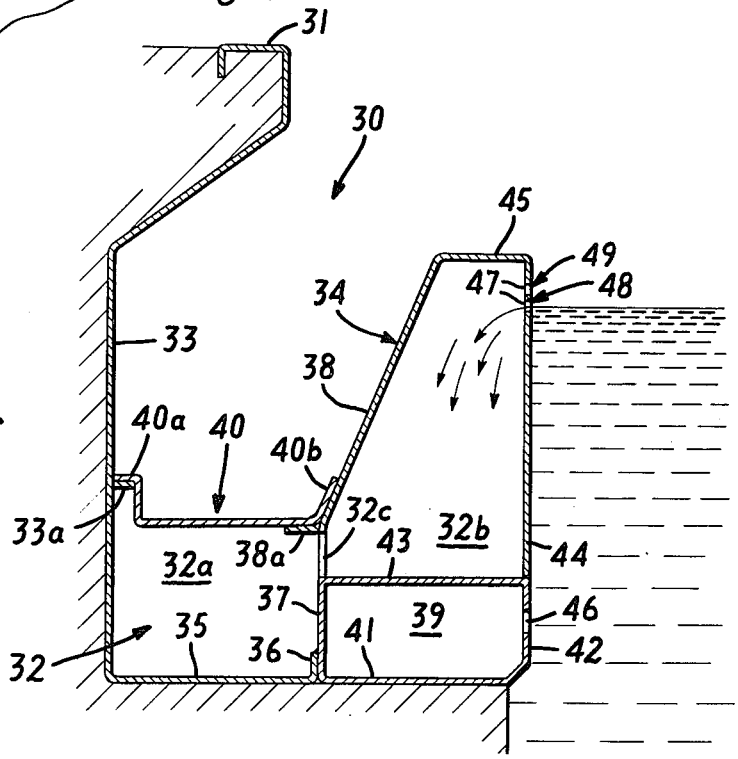
FIG. 6 represents a view in cross-section taken along the line 6—6 of FIG. 5.

The gutter system of FIGS. 5 and 6 is similar to that of FIGS. 3 and 4, with the provision of a clean water feed conduit 39 below the gutter conduit 32*b.* This perimeter gutter is also made up of a number of modular gutter units 30, which are fitted together about the perimeter of the pool during construction of the pool, the abutting ends being bonded together by welding, brazing or soldering. The gutter is made of sheet stainless steel, formed in the configuration shown in FIG. 6, with a top coping 31, and a second gutter 32 formed with upstanding sides 33, 34, and a bottom 35, a side 38, a bottom 43, and an upstanding pool-side 44, and top 45. The gutter 32 is actually in two portions, 32*a* and 32*b.* The side 34 of the gutter is made up of three parts: the upstanding flange 36, extending up from the bottom 35, the portion 37, which serves as the side wall of the clean water inlet feed conduit 39, and the side 38 of the upper portion 32*b* of the gutter conduit. A number of openings 32*c* connect the two portions of the gutter conduit.

The inlet feed conduit 39 is formed of stainless steel box beam tubing, and the second gutter conduit 32*b* is folded around and buttwelded at its ends to the top of the sides 37 and 42 of the feed conduit. The feed conduit has a bottom 41 and a pool-side 42, with a top 43 serving also as the bottom of the first gutter conduit 32*b* directly above. The sides 42, 44 together constitute a retaining wall about the perimeter of the pool, as is best seen in FIG. 6.

The water feed conduit 39 includes a plurality of openings 46, regularly spaced about the pool and serving as pool feed inlets for clean water from the feed conduit into the pool, below the surface of the water level in the pool, as is seen in FIG. 6. The side 44 of the gutter conduit 32*b* is provided with a plurality of narrow, horizontal slots 47 arranged in two parallel rows 48, 49. These provide at the water level shown in FIG. 6 capacity for skimming flow equal to about 75% of the perimeter of the pool.

Resting on flange 33*a* of side 33 and 38*a* of side 38 is a gutter trough 40, formed in a U-configuration, with flanges 40*a,* 40*b.* The trough 40 is removable, merely by lifting out, in which event the capacities of gutters 32, 40 are combined in one.

The skimming action of this gutter system is exactly the same as that in FIGS. 1 and 2, and reference is made to this description. The water inlet feed by way of the feed conduit 39 and openings 46 through wall 42 provides a uniform distribution of fresh water throughout the perimeter of the pool, matching a skimming flow which is equally uniform about the perimeter of the pool by way of the openings or slots 47. The skimming flow proceeds into the closed gutter conduit 32, and is kept separate from the flow in the gutter trough 40 arising from wave action or surges, as well as from the clean water feed conduit 39. Water flowing in the gutter trough 40 and in gutter conduit 32 is fed back to the water filter and pump, where it is cleaned, and then recirculated to the pool by way of the feed conduit 39.

Figure 7:
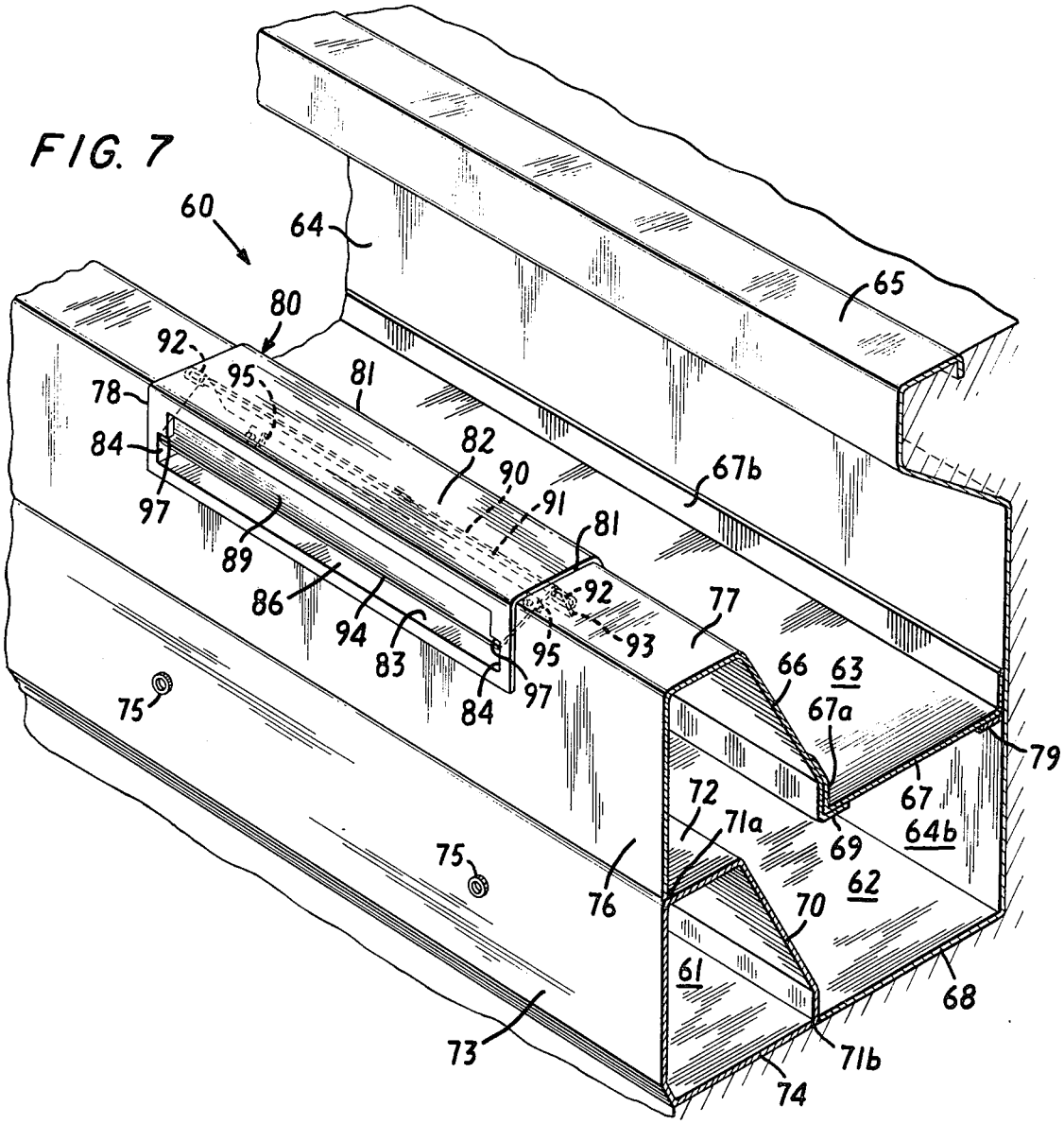
FIG. 7 is a view in elevation of another type of perimeter gutter of the invention; including a through skimmer passage fitted with a fluid flow and fluid pressure responsive weir.
Figure 8:
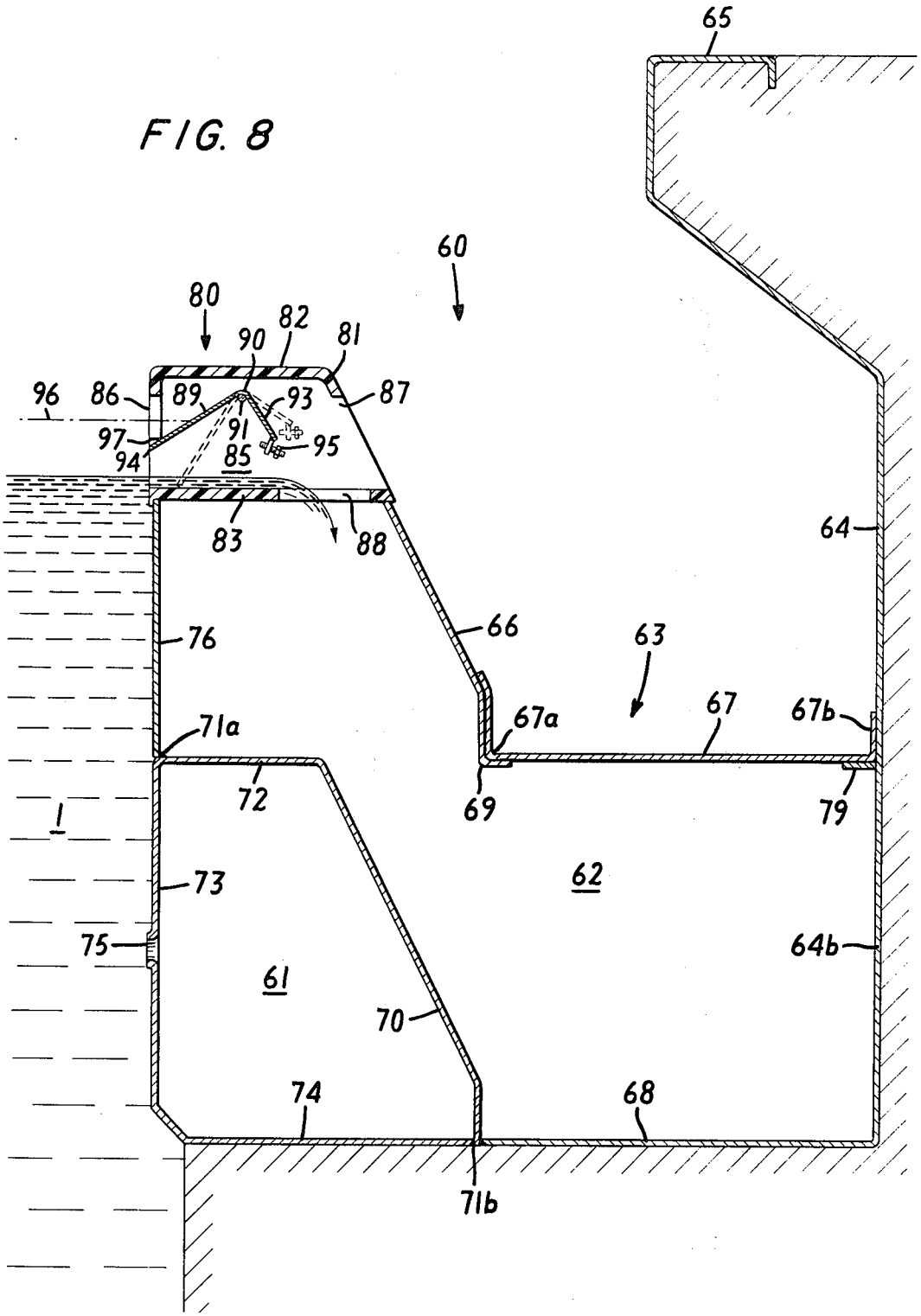
FIG. 8 is a view in cross-section taken along the line 8—8 of FIG. 7.

The perimeter gutter 60 shown in FIGS. 7 and 8 has a pool-side clean water feed conduit 61, a pool-side skimming-flow gutter conduit 62, and an open gutter trough 63 that is removable on the other side of the gutter conduit 62. This perimeter gutter 60 is made up of a number of modular units, of which one is shown in FIG. 7, which are fitted together about the perimeter of the pool in the course of the construction of the pool, being bonded together at their abutting ends by welding, brazing, or soldering. This gutter is formed of sheet stainless steel which is shaped at one end to form the coping 65 about the perimeter of the pool, from which a continuation as upstanding wall 64 extends to define the bottom 68 of the enclosed gutter conduit 62, the bottom 74 and pool-side wall 73 of the enclosed water feed conduit 61, the pool-side wall 76 of the gutter 62, the top 77 of the gutter, and side wall 66 of the gutter 63, terminating in a flange 69. The open gutter trough portion 63 is formed of another sheet of stainless steel shaped to define the gutter bottom 67, the edges thereof at flanges 67*a,* 67*b,* abutting the side walls 64, 66 and resting on flanges 69, 79, attached to sides 66, 64 respectively.

The conduit 61 is formed of a third sheet of stainless steel, which is folded around to define top wall 72 and gutter side wall 70 of the conduit, and the ends at 71*a,* 71*b* bonded together by welding, soldering or brazing to the first sheet of stainless steel, thus defining a top wall 72, a pool side wall 73, a bottom 74, and a gutter side wall 70. The pool side 73 is provided with a number of inlet openings 75, for introducing clean feed water into the pool below the water level thereof.

It will be apparent that the skimming-flow gutter conduit 62 is defined by bottom wall 68, side wall 70, top wall 72, side wall 76, top wall 77, side wall 66, bottom wall 67, and side wall 64*b.*

A portion of each of side walls 66, 76 and top 77 at the top of the skimming-flow gutter conduit 62 is cut out, providing a recessed opening 78 in which is fitted a flow- and pressure-responsive weir 80 in accordance with the invention. This weir includes a weir housing 81, made of molded plastic, although it can also be made of stainless steel, and provided with a top 82, bottom 83, and side walls 84, and a through passage 85 therewithin, opening at 86 onto the pool side to the pool, and at 87 on the opposite side onto the gutter trough 63. The bottom 83 of the weir housing 81 has a narrow open slot 88, extending all the way across the bottom 83 and longitudinally of the perimeter gutter, and serving as an inlet opening into the enclosed gutter conduit 62.

The weir housing 81 is securely anchored in a leak-tight fit to the walls 66, 76, 77, of the skimming-flow gutter conduit 62, and the top 82 of the weir housing 81 is flush with the top 77 of the conduit 62.

It will be apparent that the passage 85 serves as a skimmer passage for the pool, which is normally at the level shown in FIG. 8, so that a skimming flow of water can flow outwardly from the pool through the passage 85 to the slot 88, where it enters the skimming-flow gutter conduit 62.

Pivotably mounted across the passage 85 is a weir gate 89, supported within weir housing 81. Provision of the housing 81 makes assembly on-site easy, since all modular units 60 can be provided with the recesses 78 shown, and the weir housing and associated parts are fitted in those units which are designed to carry the skimmers and the weirs, while the others are closed off. This structure also facilitates servicing, replacement or repair of weir units during the life of the pool.

The gate 89 is pivotably mounted at its top edge 90 on pivot pins 91, which rotate in bearing sockets 92 in the side walls 84 of the weir housing 81. The gate 89 has a flap 93 on the other side of the pivot pins 91, and this flap carries a counterweight 95. The top 82 of the weir housing 81 is provided with a downwardly extending flange 97 at the inlet to the passage 85, and this serves as a stop, limiting the pivotal movement of the gate 89 to the position shown in FIGS. 7 and 8. The counterweight balances the gate against the stop, and holds it there, with its leading edge 94 in a position well above the normal fluid level of the flow in passage 85.

In operation, the leading edge 94 of the gate 89 is well above the normal flow level in passage 85. If flow increases beyond the predetermined maximum level, to level 96, the flow encounters the leading edge 94 of the gate 89, the velocity and static head pressure of the flow scooped up by the leading edge 94 of the gate overcomes the force of the counterweight 95, and the gate 89 swings down, to the dotted line position shown in FIG. 8, to close off the passage 85, and is held there by static head fluid pressure in the passage. When the fluid level subsides below the level 96, static pressure eventually diminishes to the point where the force applied by the counterweight 95 returns the gate 89 to the stop-abutting position, where it is held by the counterweight until flow once again exceeds the predetermined maximum.

During normal flow, the skimming action is provided via the passage 85, such water entering the passage 85, passing through the slots 88 into the conduit 62, whence it is fed back through the pool recirculation system, after cleaning by filtration or other means to remove the debris carried by the skimming flow into the conduit 62, after which the clean water is pumped to the water feed conduit 61, and returned to the pool via inlets 75.

When swimmers enter the pool, or if the water level increases for some other reason, and the water level rises above the predetermined minimum, the gate 89 closes, and skimming flow via passage 85 halts, and remains halted for so long as the water level remains above the predetermined maximum. During this condition of the pool, an adequate in-surge flow capacity is provided by the additional height of the pool side wall 76 between the skimmer passage 85 and the top 77 of the conduit 62. Wave action or surges beyond the predetermined maximum flow over the top 77 of the conduit 62 into the open gutter 63, whence the water is again carried by way of the pool recirculation system back through conduit 61 to the pool, after cleaning.

In the event that the surge flow or wave action flow over the top 77 of the conduit 62 is very large, and is sufficient to fill the gutter 63 to the level of passage 85, the gutter does not rise above this level to a flooded level at the top 77 of the conduit 62, because a reserve gutter capacity is provided by the gutter 62. Access to skimming-flow gutter conduit 62 is provided by the open end 87 of the passage 85, with flow therethrough via slot 88. Such access is open even though gate 89 is closed. This additional flow capacity is more than adequate to accommodate any excessive surge or wave flow across the top 77 of the conduit 62, and thus the gutter system is not susceptible of being flooded under any conditions while the gate 89 is closed.

The capacity of the gutter trough 63 can be combined with the gutter 62 merely by lifting out the gutter trough. Then, all flow over the top 77 of the gutter has the volume of gutter 62 in which to collect, which ensures no spill back due to flooding of the gutter and inadequate drain-off via slots 88 under massive flows over the top 77.

Figure 9:
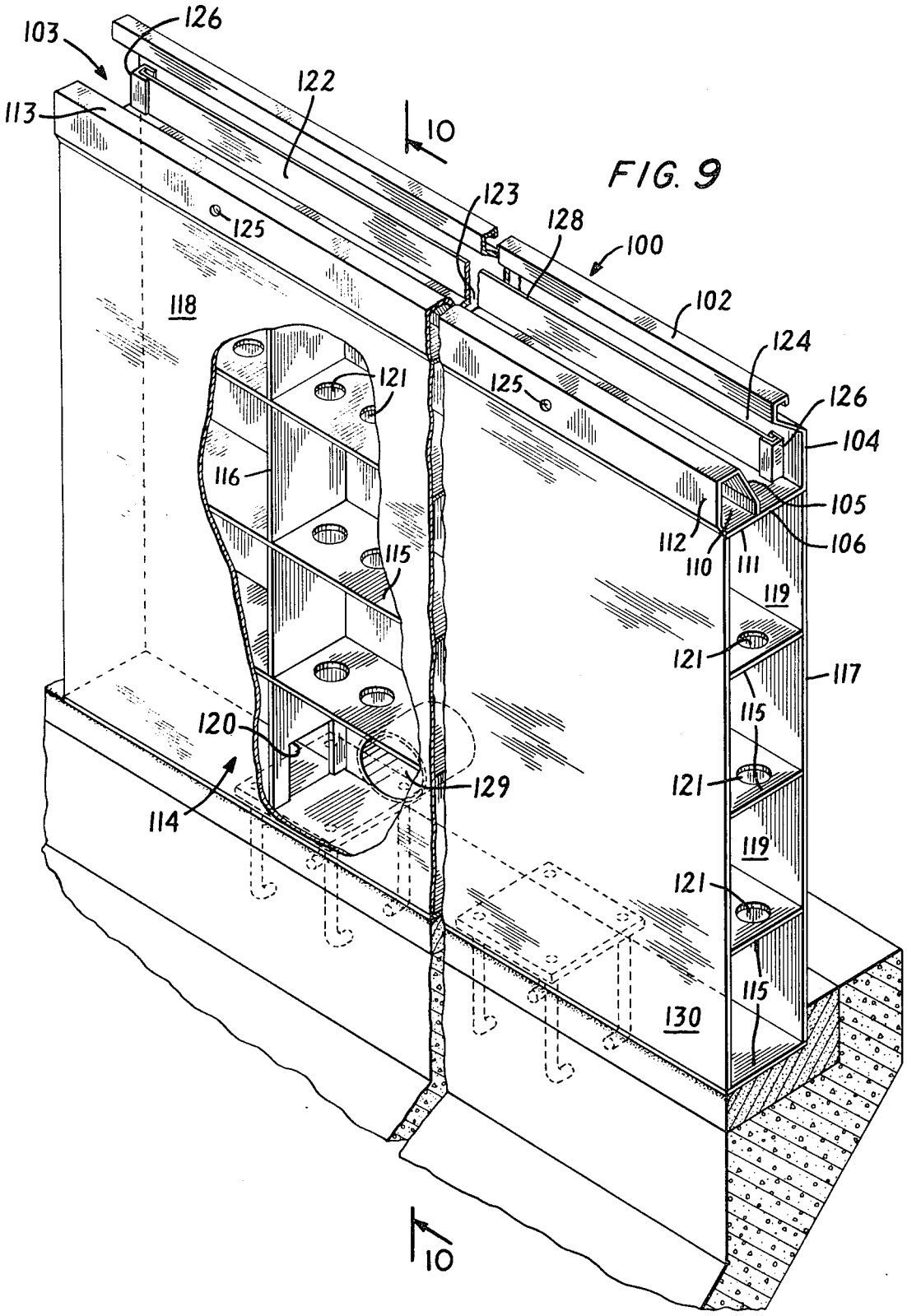
FIG. 9 represents a view in elevation of an embodiment of nonflooding perimeter skimming pool-side gutter wall in accordance with the invention.
Figure 10:
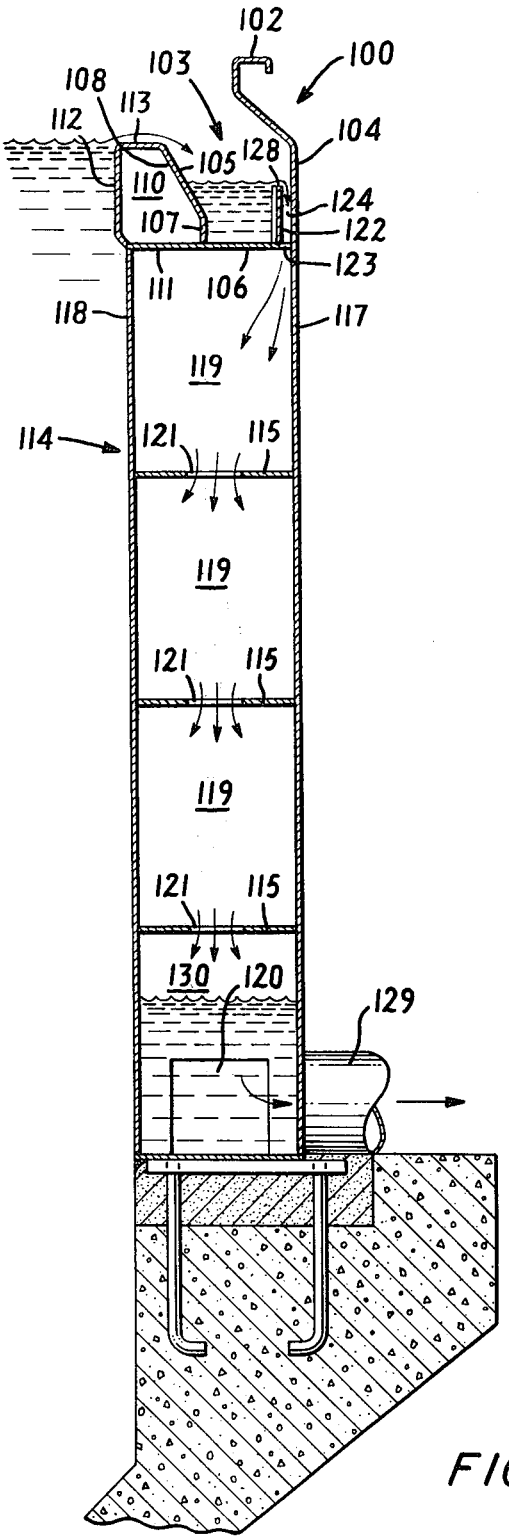
FIG. 10 represents a view in cross-section, taken along the lines 10—10 of FIG. 9.

The perimeter pool-side gutter wall of FIGS. 9 and 10 is made of a number of modular units 100, of which one is shown in FIGS. 9 and 10, which are assembled on-site and bonded together by welding, soldering or brazing, to form a gutter wall extending around substantially the entire circumference of the swimming pool. Each wall unit 100 is made of stainless steel sheet in a honeycomb construction formed with a top coping 102 and an open gutter trough 103 with upstanding sides 104, 105 and a bottom 106. The side 105 is in fact made up of two sections, bonded together by welding, a lower flange 107 extending upwardly from the bottom 106 of the gutter trough 103, and the side 108 of a closed pure water feed conduit 110.

The conduit 110 has a bottom 111, two upstanding sides, a gutter side wall 108 and a pool side wall 112, and a top 113. The side 112 serves as a perimeter retaining wall for the pool water, as is best seen in FIG. 10.

The water feed conduit 110 includes in pool-side wall 112 a plurality of openings 125, regularly spaced about the pool, and serving as pool feed inlets for clean water from the feed conduit 110 into the pool, below the surface of the water level in the pool, as seen in FIG. 9.

The pool-side retaining wall 114 supports the gutter trough 103, and is of a honeycomb structure, with a plurality of horizontal supporting walls 115 and vertical suporting walls 116 retained between outside wall 117 and pool-side wall 118. The resulting cells 119 are interconnected at the bottom level by passages 120 and vertically by apertures 121, so that all four levels of hollow wall 114 are in fact combined and constitute a second enclosed gutter conduit. The entire wall so serves, by providing passages 120 and apertures 121 throughout the cellular structure. Line 129 leads from the lowest level 130 to the pool recirculation system.

Disposed parallel to and inwardly of the side wall 104 of the gutter trough 103 are a plurality of inner side wall sections 122 that are removable, and defined therebetween narrow channels 124 leading to a slot 123 in the bottom 106 of the trough 103. The sections 122 extend to a level just below the top 113 of the feed conduit 110. When water in trough 103 reaches the top 128 of the sections 122, it then flows over the top 128 into the space 124 between wall sections 122 and side wall 104, and then, passing through slots 123, enters the gutter wall 114. Such water has its orgin in the gutter trough 103, while water flowing over the top 113 of the closed conduit 110 enters the gutter trough 103.

During normal flow conditions, the skimming flow courses over the top 113 of the closed conduit 110. Water from the pool flowing across the top of the conduit 110 enters the gutter trough 103, and is thence led back through the pool recirculation system by way of the filter and pump to the water feed intake for the pool. Dirt washed into the gutter by the skimming action is removed at the filter. The recirculation system and dirt removal filter system are conventional, and are not shown.

When swimmers enter the pool, the water level may rise, and their movement may also create flow surges and waves. This increases the flow of water across the top 113 of the conduit 110, and the amount and level of water in the gutter trough 103 increases. In the event that the water level in the gutter reaches the level of the top 128 of sections 122, such water can flow through the spaces 124 and slots 123 into the gutter wall 114. The flow capacity of the spaces 124 and slots 123 is such that the water level in the gutter trough 103 cannot rise appreciably above the level of the slots under any surge or wave flow conditions. A further and adequate reserve in surge flow capacity is provided by the additional height of the wall 105 between the top 128 of sections 122 and the top 113 of the conduit 110, so that the gutter trough 103 never floods under any surge or wave conditions. Water entering the gutter wall 114 also is led back through the pool recirculation system by way of the line 129, and the filter and pump to the water feed intake for the pool.

While the water level in the gutter trough 103 is at the level of the top 128 of sections 122, dirt at the level of the top 128 may pass through the slots 123 into the wall 114. The dirt entering the wall 114 via slots 123 is kept completely separate from the gutter 103, and is removed separately in the pool water recirculation system.

If desired, the capacity of gutter trough 103 can be combined with gutter wall 114 by removing side wall sections 122. They are retained in channels 126, and simply lift out. When removed, all water in trough 103 simply flows through slots 123 into the wall 114.

The perimeter gutters shown in the drawings are made of stainless steel, but it will, of course, be understood that other metals cam be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter of plastic material, either in whole or in part. There are plastics now available which are sufficiently strong to withstand the wear and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter, as shown in the embodiments of FIGS. 1 and 2.

The use of modular units, such as are shown in the drawings, is preferred, because this permits mass production of the gutter system at a point remote from the swimming pool, with easy and inexpensive transportation from that point to swimming pool construction sites anywhere in the world. The modular units can then be assembled on site to form any type of configuration of swimming pool. The modular units can be made in straight sections for rectangular or other straight-sided pool shapes, while curved sections can be made for pear-shaped, elliptical, circular or other round-sided pool configurations.

The modular units can be fitted together by welding, soldering or brazing, in the case of metal units, by bonding, using various types of adhesives, in the case of metal or plastic units; or by heat-sealing, ultrasonic welding, or heat-bonding, in the case of thermoplastic plastic units. Plastic units which are not fully heat-cured can be bonded and then cured in situ to form a permanent bond on site, in the course of construction of the pool.

The perimeter gutter system of the invention can be used completely around the pool perimeter, as desired. The most uniform skimming action and gutter action is of course obtained when the entire perimeter of the pool is provided with such a gutter.

While construction of the gutter in the form of modular units has been described, it will also be appreciated that the gutter system can be formed on site in the configurations shown using concrete or plastic material, and can form an integral part of the pool wall, by casting or pouring into suitable frames, so that the material can harden and set in the desired pool shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a handmade gutter system on the pool site.

The gutter system can also be made from bricks or tiles, which are built up in the desired configuration. These can be the usual types of materials, preferably with a ceramic facing, so that it is leakproof, with the tiles being bonded together with water-resistant adhesive or cement.

A fresh water feed conduit can also be fitted within the gutter trough 3 of FIGS. 1 and 2, at the pool-side retaining wall 5, so as to nestle in the corner of the gutter between wall 5 and bottom 6 of the gutter.

A fresh water feed conduit can also be fitted against the coping walls 4, 23, 33, 64 within the closed gutter conduits of FIGS. 1 to 8. In this event, the inlet openings must extend not only through the feed conduit wall but also through the pool-side retaining wall of the gutter. This system is as effective as that shown but it is somewhat more difficult to manufacture, because of the fitting of the conduit within the gutter, and a consequent bonding problem.

The level of the skimmer openings with respect to the bottom of the gutter conduit can be adjustable, so as to provide adjustment of the water level permitted in the pool before skimming flow via the openings into the gutter conduit commences. This adjustment can be provided for by forming the openings in the pool-side retaining wall as vertical slots or within an extended vertical height, and disposing a movable barrier member over the openings, with the opening or openings of the desired size and shape in the barrier member. Vertical movement of the barrier member over the wall openings adjusts the height of the opening or openings in the barrier member, and these openings are always in register with the openings in the wall. There has to be a fluid-tight seal between the barrier member and the retaining wall, which can be provided for by a gasket or O-ring seal therebetween. The barrier member can move along slots with set screws fixing it at the desired skimmer opening and thus pool level.

The skimming openings can be of any desired size and shape providing a sufficient skimming action. Preferably, they are elongated and substantially horizontal. They also should limit flow to prevent surges and waves from entering, and hence are narrow. They should not exceed about one inch in height and should have a length to height ratio of from 1:1 to 100:1, although the latter limit is not critical. The limit is actually imposed only by the feasible length of gutter section and the strength of the material used for the retaining wall.

The swimming pool can be equipped with water filtration and cleaning recirculation systems. The gutters usually feed water therein to such systems by gravity. Pumps can be provided, and the gutters can also be provided with jet water inlets to direct a driving flow of water along the gutters, to flush out the gutters, annd to drive water along the gutter towards the water recirculation system. Such jet water inlets are described in U.S. Pat. No. 2,932,397 to Ogden, dated Apr. 12, 1960.

Other variations and modifications in the invention will be apparent to those skilled in the art.

Having regard to the foregoing disclosure, the following is claimed as the inventive and patentable embodiments thereof:

1. A perimeter gutter for swimming pools comprising, in combination, first and second gutter conduits for disposition about the perimeter of a swimming pool, of which conduits at least one is an open gutter trough nested in and supported by the other gutter conduit; a retaining wall on the pool-side of the gutter conduits, over the top of which wall water may flow from the pool into the open gutter trough; the open gutter trough having at least one wall in common with the other gutter conduit separating available space of the other gutter conduit from available space of the gutter trough, of which common wall at least a portion is removable, so that upon removal of the wall, said available spaces are combined and form a single gutter whose available space is at least the aggregate of the available space of both gutter conduits.

2. A perimeter skimming gutter for swimming pools in accordance with claim 1, comprising a clean water feed conduit for feeding clean water into the pool at a point below the top of the retaining wall.

3. A perimeter skimming gutter in accordance with claim 2 in which the clean water-feed conduit is provided in one of the gutter conduits.

4. A perimeter skimming gutter in accordance with claim 1, in which the other gutter conduit viewed in cross section has support members projecting inwardly towards each other approximately horizontally from opposite walls thereof, receiving and supporting thereon mating wall portions of the gutter trough.

5. A perimeter skimming gutter in accordance with claim 4, in which the support members are flanges extending approximately horizontally receiving thereon mating flanges of the gutter trough, extending outwardly and approximately horizontally therefrom.

6. A perimeter skimming gutter in accordance with claim 4, in which one support member is a horizontal flange receiving and supporting thereon a bottom wall of the gutter trough, and the other support member is a horizontal flange receiving and supporting a mating flange at a top wall of the gutter trough.

7. A perimeter skimming gutter in accordance with claim 1, in which both gutter conduits are open troughs, and one trough is nested within and above the bottom of the other trough.

8. A perimeter skimming upper gutter in accordance with claim 7, comprising an open grid extending over the gutter trough.

9. A perimeter skimming gutter in accordance with claim 1, in the form of a modular unit adapted to be assembled end-to-end with other such units to form the perimeter gutter of a swimming pool.

10. A swimming pool comprising sidewalls and a bottom adapted to retain water therewithin, and, extending about the upper perimeter of at least a portion of one side wall thereof, a perimeter skimming gutter in accordance with claim 1.

11. A swimming pool in accordance with claim 10, including a water cleaning and recirculating system for collecting water flowing into and along the gutter trough, cleaning it, and returning it to the pool.

12. A perimeter skimming gutter for swimming pools in accordance with claim 1, comprising at least one skimming flow passage through the retaining wall.

13. A perimeter skimming gutter for swimming pools in accordance with claim 12, in which one of the gutter conduits receives the skimming flow of water through the passage, and the other gutter conduit receives flow over the top of the retaining wall.

14. A perimeter skimming gutter for swimming pools in accordance with claim 1, comprising an overflow outlet leading from one of the gutter conduits to the other through the common wall therebetween.

15. A perimeter skimming gutter for swimming pools in accordance with claim 14 in which the overflow outlet is a passage for skimming flow opening into one of the gutter conduits.

16. A swimming pool comprising side walls and a bottom adapted to retain water therewithin, and, extending about the upper perimeter of at least a portion of one side wall thereof, a perimeter skimming gutter in accordance with claim 13.

17. A swimming pool comprising side walls and a bottom adapted to retain water therewithin, and, extending about the upper perimeter of at least a portion of one side wall thereof, a perimeter skimming gutter in accordance with claim 14.

18. A perimeter skimming gutter in accordance with claim 1, comprising a plurality of narrow, elongated, skimmer openings through the wall below the top thereof at a height to maintain a predetermined water level in the pool, and providing a skimming flow of water through the skimmer openings into one of the gutter conduits the top of the retaining wall being spaced above the openings at a height to retain the pool water within the pool perimeter at water flows, wave actions and surges up to a predetermined maximum, while allowing excessive water flows, wave actions and surges beyond such maximum to flow over the top of the wall into the first gutter conduit.

19. A perimeter skimming gutter in accordance with claim 1, comprising a fluid flow communication between the first and second gutter conduits, such fluid flow communication entering the gutter trough at a level below the top of the retaining wall, and adapted to drain off water from the gutter trough at any level exceeding a predetermined level therein, so as to inhibit the level of water in the gutter trough from ever reaching the top of the retaining wall.

20. A perimeter skimming gutter in accordance with claim 1, comprising a skimming weir assembly disposed through the retaining wall below the top thereof, at a height to maintain a predetermined water level in the pool, and to provide a skimming flow of water through the weir at such predetermined water flow through the pool, the top of the wall being spaced above the weir at a height to retain the pool water within the pool perimeter when the weir is closed at water flows, wave actions, and surges up to a predetermined minimum, while allowing excessive flows, wave actions, and surges beyond such minimum to flow over the top of the wall into the first gutter, the skimming weir assembly comprising a weir support; a fluid flow passage; a weir closure member mounted in the support across the passage to move between flow-open and flow closed positions, and a weir closure control responsive to fluid level and/or fluid flow and/or fluid pressure and which in the flow-open position is disposed to encounter a fluid level and/or fluid flow and/or fluid pressure in the passage above a predetermined minimum, and responds to the motive force applied by such fluid level and/or fluid flow and/or pressure to move the member from the flow open position towards a flow-closed position.

21. A perimeter gutter in accordance with claim 1, comprising a fluid flow communication between the second gutter conduit and at least one of the swimming pool and the first gutter conduit, such fluid flow communciation being at a level below the top of the retaining wall.

22. A perimeter skimming gutter in accordance with claim 1 in which the second gutter conduit is within a peripheral wall below the first gutter trough and in fluid flow connection with the first, such fluid connection entering the first gutter trough at a level below the top of the retaining wall, and adapted to drain off water from the first gutter trough at any level exceeding a predetermined maximum level therein, so as to inhibit the level of water in the first gutter trough from reaching the top of the retaining wall, the first gutter trough and second gutter conduit having at least one side wall in common therebetween, separating available space of the second gutter conduit from available space of the first gutter trough, of which common side wall at least a portion is slidably supported in open channel members, so that it can be lifted out.

* * * * *